United States Patent [19]

Cote

[11] Patent Number: 4,699,390

[45] Date of Patent: Oct. 13, 1987

[54] COMBINED ROLLER AND BLADE SKATE

[76] Inventor: Bernard Cote, 8620 Louis-Hénault Street, Riviére-des-Prairies, Québec, Canada, H1E 4K7

[21] Appl. No.: 347,088

[22] Filed: Feb. 8, 1982

[51] Int. Cl.[4] ..... A63C 17/06

[52] U.S. Cl. ..... 280/11.23; 280/11.19; 280/11.2

[58] Field of Search ..... 280/8, 9, 11.22, 11.23, 280/11.12, 600,

[56] References Cited

U.S. PATENT DOCUMENTS

| | | | |
|---|---|---|---|
| 525,126 | 8/1894 | Baker | 280/8 |
| 1,530,211 | 3/1925 | Siemnash | 280/11.22 |
| 2,220,557 | 11/1940 | User | 280/11.22 |
| 2,644,692 | 7/1953 | Kahlert | 280/11.22 |
| 2,909,375 | 10/1959 | Warner | 280/11.23 |
| 3,552,746 | 5/1971 | Nagin | 272/3 |
| 3,689,091 | 5/1972 | Nagin | 280/11.12 |
| 4,218,069 | 8/1980 | Baikie | 280/11.12 |

FOREIGN PATENT DOCUMENTS

| | | | |
|---|---|---|---|
| 216190 | 2/1922 | Canada . | |
| 163086 | 9/1948 | Fed. Rep. of Germany | 280/11.22 |

*Primary Examiner*—David M. Mitchell

[57] ABSTRACT

An innovative skate is disclosed, for use on a synthetic plastic surface. The skate comprises a boot, a rigid sole and a train secured to the sole. The train has a rotatably mounted roller wheel at its heel portion and a second rotatably mounted roller wheel located generally under the ball portion of the sole. The train is also provided with a blade extending forwardly of the second roller wheel. The blade and the two roller wheels are aligned along the central longitudinal axis of the sole.

1 Claim, 5 Drawing Figures

FIG. 1
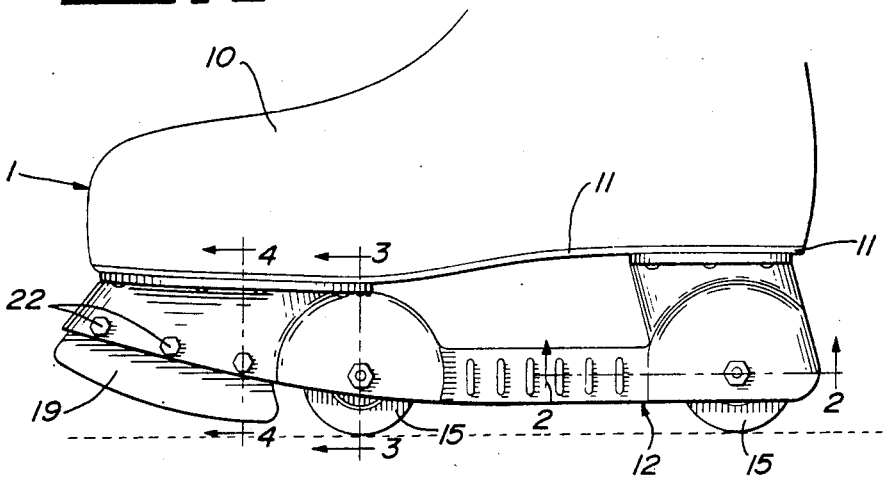
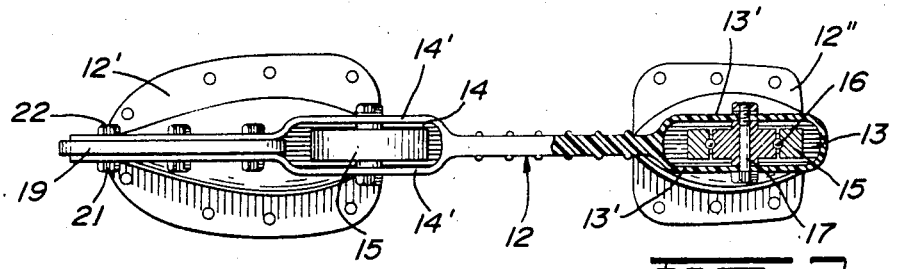
FIG. 2
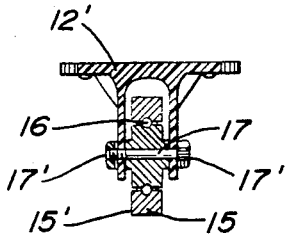
FIG. 3
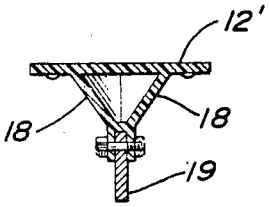
FIG. 4
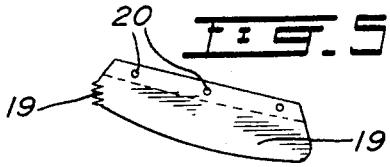
FIG. 5

COMBINED ROLLER AND BLADE SKATE

FIELD OF THE INVENTION

The present invention relates to sports equipment, more specifically to a novel skate having both roller wheels and a front end blade adapted for use on the new synthetic skating surfaces now becoming popular for physical recreation.

BACKGROUND OF THE INVENTION

Both roller skates and ice skates are very well known and have been used for a number of years on wooden or other hard surfaces and on ice, respectively. However, neither of these types of skates are suitable for use on the new synthetic material which has a coefficient of friction between that of wooden type material and ice. Thus ice skates would not slide easily enough while the conventional wide and laterally-spaced roller would render turns and other manoeuvers very difficult. The prior art does teach two or more rollers longitudinally and axially aligned, some rollers being detachable. The present invention is an improvement over the prior art.

OBJECTS OF THE INVENTION

It is an important object of the present invention to provide a skate provided with a front end blade combined with a central and a rear roller, the blade and the rollers being longitudinally and axially aligned.

It is another important object of the present invention to provide a skate of the above type wherein the front end blade can be of varying lengths as a function of boot size.

It is another object of the present invention to provide a skate wherein the combination of a front end blade with the rollers greatly improves and facilitates movement on a synthetic plastic surface.

SUMMARY OF THE INVENTION

The above and other objects and advantages of the invention are realized according to a preferred embodiment of a skate comprising a boot and a train rigidly secured to the sole of the boot and extending from the heel to the toe of the same. The train is made of suitable lightweight rigid material, and extends along the central longitudinal axis of the sole.

Two roller wheel retaining means are provided in the train: a first wheel retaining means located under the heel portion of the skate sole and a second wheel retaining means longitudinally forwardly-spaced from the first means and located generally under the ball portion of the sole.

A roller wheel is rotatably mounted in both wheel retaining means about a transverse axle.

The front portion of the train is provided with a longitudinally extending blade retaining means to which is rigidly attached a downwardly projecting blade. The latter extends from immediately forwardly of the second wheel retaining means to the front tip of the train. The surface-contacting edge of the blade is slightly curved upwardly and forwardly for a reason explained herebelow.

The two roller wheels and the blade are longitudinally aligned with the train along the central longitudinal axis of the sole.

An additional but non-essential feature of the invention provides for teeth at the forward edge of the blade if the skate is to be used for figure or artistic skating.

BRIEF DESCRIPTION OF THE DRAWINGS

The above will be more fully understood by having referral to the preferred embodiment of the invention, illustrated by way of the accompanying drawings, in which:

FIG. 1 is a side elevation of the skate according to the invention, showing most of the boot;

FIG. 2 is a bottom view of the train combined with a cross-sectional view of the heel portion taken along line 2—2 of FIG. 1;

FIG. 3 is a cross-sectional view taken along line 3—3 of FIG. 1;

FIG. 4 is another cross-sectional view taken along line 4—4 of FIG. 1, and FIG. 5 is a side elevation of a blade provided with teeth at its forward edge.

Like numerals refer to like elements through-out the drawings.

DETAILED DESCRIPTION OF THE INVENTION

Skate 1 of the present invention comprises a boot 10 having a stiff, rigid sole 11 as in a conventional roller or ice skate.

Rigidly secured to sole 11 at the toe and heel portions thereof is a train 12 having upper toe and heel plates 12' and 12'' respectively. Train 12 is preferably made of lightweight rigid plastic material, as indicated in the figures, and extends along the central longitudinal axis of the sole.

Train 12 is provided with a first and second wheel retaining means consisting of a wheel well 13 at the heel portion thereof and another wheel well 14 generally located under the ball portion of the sole 11 respectively. Both wheel wells 13 and 14 are integrally formed in train 12, each being downwardly open and having transversely spaced-apart side walls 13' and 14' respectively.

A roller wheel 15 is rotatably mounted in each wheel well 13 and 14. Wheels 15 are preferably made of hard steel, being relatively transversely thin and having a transversely, flat circumferential surface with sharp circumferential edges 15'. They are also provided with ball bearing 16 in the known manner and are secured in position by a central transverse axle 17. The latter is afixed to its wheel well by means of external nuts 17'.

The front or toe portion of train 12 is provided with a blade retaining means, consisting of a pair of downwardly extending and opposed flanges 18 thus describing a V-shape when seen longitudinally, as seen clearly in FIG. 4. At their lower ends these flanges 18 are vertically oriented, thereby defining a longitudinally extending slot, also as shown in FIG. 4.

A skate blade 19 is adapted to fit into the slot and is removably held therein by holes 20 along its upper edge (cf. FIG. 5) in combination with nuts and bolts 21 and 22. Blade 19 has a slightly convexly curving lower edge for a purpose explained hereinafter. The rear bottom tip of blade 19 is spaced above the straight line tangential to the skating surface-engaging zone of both roller wheels 15, as shown by the dotted line of FIG. 1. From this rear bottom tip, the lower skating edge of blade 19 becomes progressively more upwardly inclined with respect to this line to terminate at the front bottom tip of the blade.

This front tip is spaced a substantial vertical distance below the toe plate 12'. The arc subtending the front and rear tips is no more than about 40 degrees, as shown in FIG. 1. Blade 19 is thinner than the width of the circumferential surface of roller wheels 15.

FIG. 5 illustrates an alternative embodiment of blade 19 wherein the front tip of the blade is provided with teeth 19', making possible the use of skate 1 for figure and artistic skating. Blade 19 is also preferably made of hard steel.

The advantages of the skate disclosed herein are multitudinous and are described as follows: the forward wheel 15 is located just slightly ahead of the center of gravity of a skater using the skate. Such an arrangement allows a skater to shift his or her weight with a minimum amount of effort onto either the front end blade 19 or onto rear roller wheel 15, with the front roller wheel 15 normally remaining on the skating surface.

Another advantage of the invention involves a blade 19 having a curved lower edge as described above. This shape allows a continuous contact with the synthetic surface during a turn. For a turn, the skater laterally inclines the blade, the more so for a sharper turn, with the curved lower edge of the blade 19 contacting the skating surface over a progressively-increasing length from back to front, as in conventional ice-skating. Such contact cannot be achieved with skates that have one or more front roller wheels because, when the skater changes direction, the rollers execute movements of differing arcs and the actual results is a braking action.

Another important feature of this invention is that varying lengths of blade 19 are provided as a function of the skate boot size: the larger the size, the longer the associated blade 19. Previously supplementary roller wheels had to be added to larger sized skates.

Blade 19 and roller 15 are preferably made of steel, as mentioned above, because steel conducts heat very well. Therefore frictional contact between blade 19 and rollers 15 and the synthetic surface will heat the former, lowering their resistance to movement over the surface. (For the same reason blade 19 is relatively thin.)

It is to be noted that the skate of this invention easily accomplishes all the manoeuvers a skater might desire. For example backward movement involves a sliding zigag movement of the blade in conjunction with the front roller wheel, which movement is almost effortless.

What I claim is:

1. A skate for use on synthetic skating surface in a manner similar to an ice-skate, said skate comprising a boot having a rigid sole affixed thereto and a train having upper heel and toe plates rigidly secured to said sole, said train extending along the central longitudinal axis of the sole, said train including a rear and a front wheel-retaining means formed below said heel plate and said toe plate, respectively, a rear and a front roller wheel rotatably mounted in said rear and front wheel-retaining means, respectively, each roller wheel having a transverse flat and hard circumferential surface with sharp circumferential edges, said front roller wheel located just slightly ahead of the center of gravity of a skater using the skate, said train further including a blade-retaining means extending below said toe plate and forwardly of said front wheel-retaining means, a skate blade rigidly and detachably secured to said blade-retaining means, both roller wheels and said skate blade being aligned along the said central longitudinal axis of the sole, said blade being thinner than the width of the circumferential surface of said roller wheels, said blade having a lower edge which is slightly convexly curved upwardly and forwardly, said blade having a rear bottom tip which is spaced above a straight line tangential to the skating surface-engaging zone of both roller wheels, said blade having a front bottom tip which is spaced a substantial vertical distance below said toe plate, said lower edge becoming progressively more upwardly inclined with respect to said straight line from said rear to said front bottom tip of said blade.

* * * * *